US005560692A

United States Patent [19]

Smith

[11] Patent Number: 5,560,692

[45] Date of Patent: Oct. 1, 1996

[54] SHROUDED SHIPPING DISPLAY CONTAINER AND STAND

[75] Inventor: Michael J. Smith, Orangeburg, N.Y.

[73] Assignee: Arrow Art Finishers, Inc., Bronx, N.Y.

[21] Appl. No.: 380,594

[22] Filed: Jan. 30, 1995

[51] Int. Cl.[6] ..... A47F 7/28; A47F 5/11; A47F 3/14

[52] U.S. Cl. ..... 312/114; 312/258; 312/259; 312/351; 211/135; 108/100; 229/23 BT; 248/174

[58] Field of Search ..... 312/114, 129, 312/138.1, 259, 263, 258, 260, 351; 248/174; 211/72, 73, 134, 135, 153, 186, 187, 195; 108/100; D6/473, 474; 206/44, 45.19, 45.31, 45.14; 229/23 BT

[56] References Cited

U.S. PATENT DOCUMENTS

| | | | |
|---|---|---|---|
| Re. 32,668 | 5/1988 | Smith | 211/149 |
| 2,688,408 | 9/1954 | Binggely | 211/72 X |
| 2,801,754 | 8/1957 | Dorfman | 108/100 |
| 2,926,778 | 3/1960 | Maguire | 211/135 X |
| 4,099,612 | 7/1978 | Hanson | 299/23 BT X |
| 4,105,152 | 8/1978 | Elward | 299/23 BT |
| 4,506,790 | 3/1985 | Muscari | 211/135 X |
| 4,519,319 | 5/1985 | Howlett | 206/45 X |
| 4,605,130 | 8/1986 | Taub | 248/174 X |
| 4,646,922 | 3/1987 | Smith | 211/186 |
| 4,723,664 | 2/1988 | Smith | 211/149 |

FOREIGN PATENT DOCUMENTS

| | | | |
|---|---|---|---|
| 1242722 | 8/1971 | United Kingdom | 206/45.19 |

*Primary Examiner*—Peter M. Cuomo
*Assistant Examiner*—Robert J. Sandy
*Attorney, Agent, or Firm*—Kirschstein et al.

[57] ABSTRACT

A shrouded container includes a display stand having a general configuration of a rectangular prism and bounding an internal space for receiving items to be displayed when the display stand is in its erected position of use, and a shroud configured to be slid over the display stand and including a top that completes the enclosure of the internal space when the shroud is mounted on the display stand to permit shipping of the items to be displayed in such enclosed space. The display stand includes a false bottom that is supported at a predetermined elevation above ground by a strip-shaped portion hingedly connecting a front region of the false bottom to an upper edge of the front wall, and by a supporting structure including two supporting flaps each extending along an inclined course from the bottom region of one of the front and rear walls of the display stand to the predetermined elevation where the supporting flaps are connected to one another to give the support structure a configuration reminiscent of an A-frame roof. The display stand further includes a true bottom that is constituted by two bottom wall portions each hingedly connected to one of the side walls of the display stand. The true bottom wall portions carry respective upholding flaps that extend substantially vertically in the central region of the display stand and are provided with locking tabs that engage in corresponding openings of the supporting flaps to lock the upholding and supporting flaps in place.

13 Claims, 4 Drawing Sheets

FIG.6
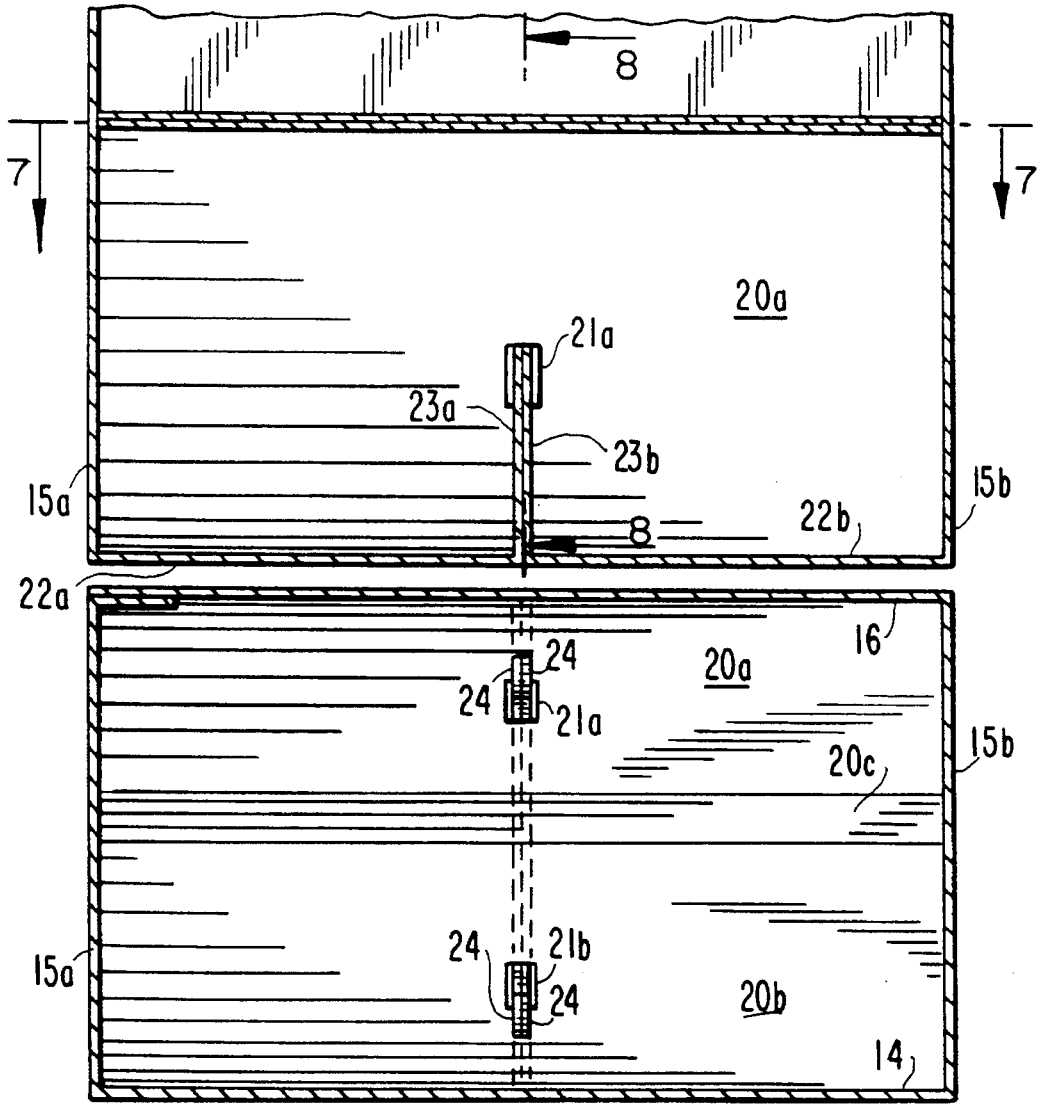
FIG. 7
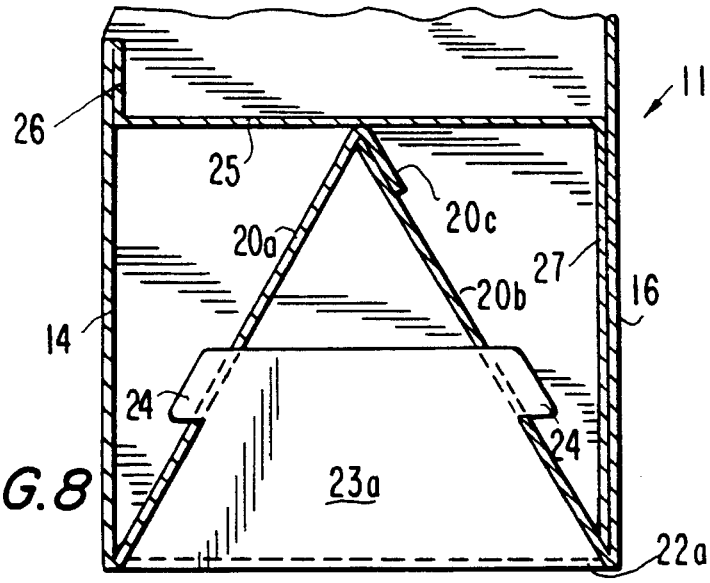
FIG.8

SHROUDED SHIPPING DISPLAY CONTAINER AND STAND

BACKGROUND OF THE INVENTION

1. Field of the Invention

The present invention relates to displaying goods in general, and more particularly to a display stand.

2. Description of the Related Art

There are already known various constructions of display stands for displaying goods on sale, for instance. Examples of display stands of this type can be found, for example, in the U.S. Pat. Nos. 4,646,922; 4,723,664; and Re. 32,668.

Such display stands typically include at least front, rear and side walls that bound an internal space, and a false bottom or shelf located above an open bottom and connected to at least some of said front, rear and side walls, the false bottom supporting the goods to be displayed in the internal space at a predetermined elevation above the open bottom and the ground. It has been established that, in view of the often considerable weight of the goods resting on the false bottom, the support provided by the connection of the false bottom to the front, rear and/or side walls is often insufficient to prevent the false bottom wall from sagging or even collapsing under the weight of such goods. Therefore, it has been proposed to enhance this supporting action by supporting the false bottom from below at a substantially central region thereof on upper edges of upright supporting flaps. However, experience has shown that even this solution is often insufficient because the upright supporting flaps are prone to buckle laterally under the pressure imparted to them by the false bottom as the latter supports the weight of the goods on display.

Such display stands are often made to be collapsible. It is customary to ship the display stands in their collapsed condition to a packer at which the stands are loaded with goods, or to their final destination, for example, a retail site, again to be loaded with goods. In the former approach, the pre-packed stands are lifted, lowered and shipped in fully-enclosed, six-sided, box-like, shipping containers. It is not uncommon for goods to fall off the stand during such lifting/lowering movements. Moreover, upon arrival at the retail site, the pre-packed stand must be lifted from the shipping container and moved to its ultimate location. Again, goods fall from the stand, and it is not uncommon for the stand to buckle, during such movements. In the latter approach, the stands are erected in situ at their ultimate location, and only then loaded with the goods to be displayed. This latter approach requires skilled retail personnel, is labor intensive and is rather expensive.

OBJECTS OF THE INVENTION

Accordingly, it is a general object of the present invention to avoid the disadvantages of the prior art.

More particularly, it is an object of the present invention to provide a display stand that does not possess the drawbacks of the known display stands of this type.

Still another object of the present invention is to devise a display stand of the type here under consideration which can be used for holding the goods not only while being on display but also during their shipment to the location at which they are to be displayed.

It is yet another object of the present invention to design the above display stand in such a manner as to improve the support of the false bottom thereof at the predetermined elevation above the ground when the display stand is in its position of use.

An additional object of the present invention is to eliminate the handling of pre-packed stands into and out of fully-enclosed shipping containers.

A concomitant object of the present invention is so to construct the display stand of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a shrouded container which includes a display stand having a closed bottom, and a shroud to be slid onto the display stand. The display stand includes interconnected front, rear, side and bottom walls extending substantially normal to one another to give the display stand a general configuration of a rectangular prism and bounding an internal space for receiving items to be displayed when the display stand is in its erected position of use. The shroud has a configuration substantially corresponding to the general configuration of the display stand and includes interconnected front, rear, and side walls corresponding to but having dimensions slightly exceeding those of the front, rear and side walls of the display stand. The shroud has an open bottom to enable the shroud to be slipped from above onto the display stand, and further includes a top wall connected to the front, rear and side walls of the shroud and completing the enclosure of the internal space of the display stand from above when the shroud is mounted on the display stand to permit shipping of the items to be displayed in such enclosed space.

The display stand is no longer shipped in a fully-enclosed shipping container and, of course, is no longer lifted therefrom or lowered therein. Instead, the lightweight shroud is simply slipped onto, or slipped off, the stand from above.

According to another aspect of the present invention, the display stand further includes a false bottom wall or shelf for the items on display to rest on, and means for supporting the false bottom wall at a predetermined elevation above the bottom wall. Such supporting means advantageously includes means for connecting a front region of the false bottom wall to the front wall of the display stand, and two supporting flaps integral with the front and rear walls of the display stand, respectively, and extending up from respective bottom regions thereof along upwardly sloping courses as considered in the erected position to reach the predetermined elevation. The supporting flaps are connected to each other, preferably about midway between the front and rear walls, thus forming a support structure reminiscent of an A-frame roof for the false bottom wall to rest on.

It is particularly advantageous for the connecting means to include a strip-shaped connecting portion integral with the false bottom wall and the front wall and joined thereto by respective hinge portions, the connecting portion extending from an upper edge of the front wall downwardly into the internal space of the display stand as considered in the erected position in substantial parallelism with the front wall to suspend the front region of the false bottom wall at a predetermined distance below the upper edge of the front wall.

In further accord with the invention, there may further be provided a reinforcing wall integral with and hingedly connected to the false bottom wall at a region thereof remote from the front region, the reinforcing wall extending downwardly in substantial parallelism and in contact with the rear wall of the display stand to enhance the supporting action of the supporting means.

According to another advantageous facet of the present invention, the bottom wall of the display stand consists of two portions each integral with and hingedly connected to one of the side walls of the display stand. Under there circumstances, there is advantageously further provided a pair of upholding flaps each integral with and hingedly connected to a region of one of the two portions of the bottom wall that is remote from the respective side wall and extending upwardly therefrom toward engagement with the supporting flaps. Last but not least, it is advantageous when the supporting flaps include respective slit-shaped openings, and when each of the upholding flaps includes a pair of oppositely disposed locking tabs each received in one of the openings of the supporting flaps to lock the upholding and supporting flaps in position relative to one another.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 6 is a sectional view taken on line 6—6 of FIG. 5;

FIG. 7 is a cross-sectional view taken on line 7—7 of FIG. 6; and FIG. 8 is another sectional view but this time taken on line 8—8 of FIG. 6.

DETAILED DESCRIPTION OF THE PREFERRED EMBODIMENT

Figure 1:
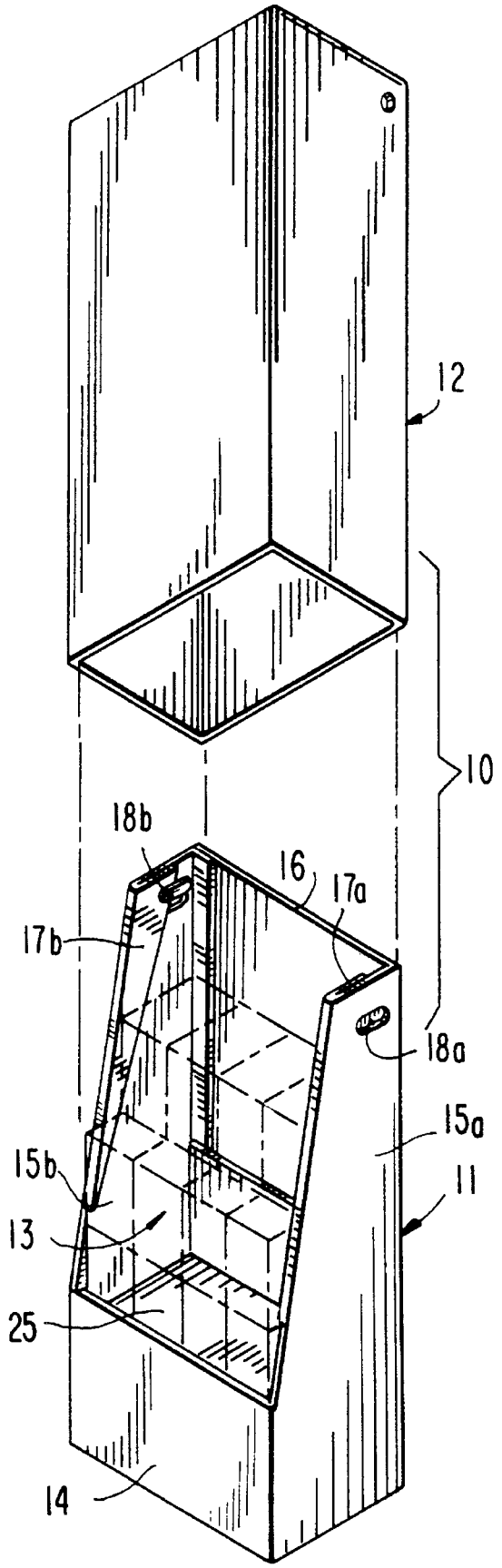
FIG. 1 is an exploded perspective view of a shrouded display container of the present invention consisting of a display stand and a shroud.

Referring now to the drawing in detail, and first to FIG. 1 thereof, it may be seen that the reference numeral 10 has been used therein to identify a shrouded display container of the present invention in its entirety. The display container 10 includes a display stand 11 having a general shape of a rectangular prism, and a shroud 12 of a shape generally conforming to that of the display stand 11. The container 10 is shown in FIG. 1 in an exploded view and as if the viewer were positioned in between the display stand 11 and the shroud 12, i.e., looking at the display stand 11 from above and at the shroud 12 from below. The shroud 12 is shown to have an open bottom, and has at least width and depth dimensions (as considered in FIG. 1) slightly exceeding the corresponding overall dimensions of the display stand 11, and a height dimension sufficient to cover most if not all of the height of the display stand 11 when the shroud 12 is slipped from above on the display stand 11.

Although this is not shown in the drawing, it is to be mentioned that the shroud 12 has a closed top. As a result of the provision and the aforementioned construction of the shroud 12 and its use in conjunction with the display stand 11, the thus obtained container 10 is fully closed on all sides and on top (as well as at the bottom, as will be discussed later). This means that the container 10 has the characteristics and appearance of an ordinary six-sided, fully-enclosed shipping box, carton or similar shipping container and can be handled in the same manner as such ordinary shipping containers, especially when the shroud 12 is connected, such as by staples or adhesive tape, in its covering position to the display stand 11.

Besides facilitating the handling, this construction also assures that respective items or goods to be eventually displayed on the display stand, which are collectively denoted in FIG. 1 by the reference numeral 13 and indicated there in broken lines as having box-shaped contours, will not unduly shift in the stand 11 during the transportation of the container 10 and particularly will not fall out of the container 10, if properly packed in the container 10 prior to shipping. Also, once the container 10 has arrived at the intended destination, it can easily be handled there, for instance, by being moved in its still shrouded condition to the location of the store where the goods 13 are to be put on display, and only then can the container 10 be opened by first discontinuing the connecting action of the aforementioned staples or adhesive tape in any known manner (by removing the staples, cutting the adhesive tape, or the like) and then sliding the shroud 12 upwardly off of the display stand 11.

Once this shroud-removal operation is completed, the display stand 10 is immediately ready to serve for displaying the articles or goods 13 that arrived in the container 10. However, to enhance the appearance, aesthetic appeal, or attractiveness of the display and/or access to the goods 13 on display, it may be preferred to remove at this time several rows of the articles 13 and store them elsewhere, so that the collection of goods 13 will have generally the appearance indicated in FIG. 1.

It may be seen in FIG. 1 of the drawing that the display stand 11 has a front wall 14, two side walls 15*a* and 15*b*, and a rear wall 16, with all directions mentioned here referring to the display stand 11 in its position of use or display condition, and as considered from the vantage point of the intended observer, i.e., a store customer or patron. Adjacent ones of the peripheral walls 14 to 16 are connected to one another by respective corner regions.

FIG. 1 also shows that the front wall 14 rises to a much smaller elevation above ground than the remaining peripheral walls and that the front edges of the side walls 15*a* and 15*b*, rather than slavishly following the aforementioned general contour, are rearwardly inclined at their regions that rise upwardly above the top edge of the front wall 14. These features improve the visibility and accessibility of the articles 13 on display. This reclining course of these front edges is obtained by folding portions 17*a* and 17*b* of the side walls 15*a* and 15*b* back about respective crease lines until they contact the remainders of the side walls 15*a* and 15*b*, as shown in the interior of the stand 11. It is also shown in FIG. 1 that the side walls 15*a* and 15*b* may be provided with respective handgrip openings 18*a* and 18*b* that facilitate manipulation with the display stand 11 in that the store personnel can insert his or her fingers into such openings 18*a* and 18*b* and thus get a good hold of the lateral walls 15*a* and 15*b*.

Figure 2:
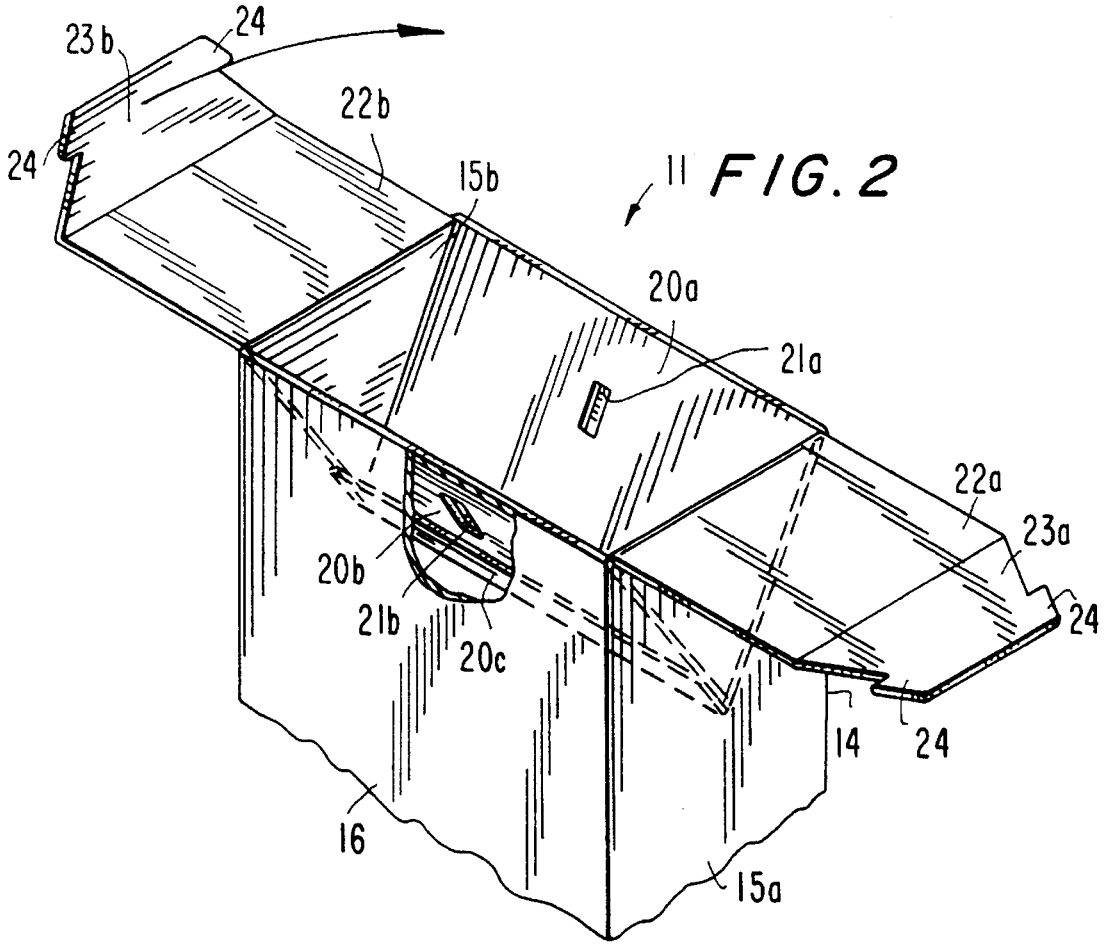
FIG. 2 is a perspective view of a bottom portion of the display stand of FIG. 1 taken during an early phase of formation of the container in an upside down orientation and with the shroud being absent.
Figure 3:
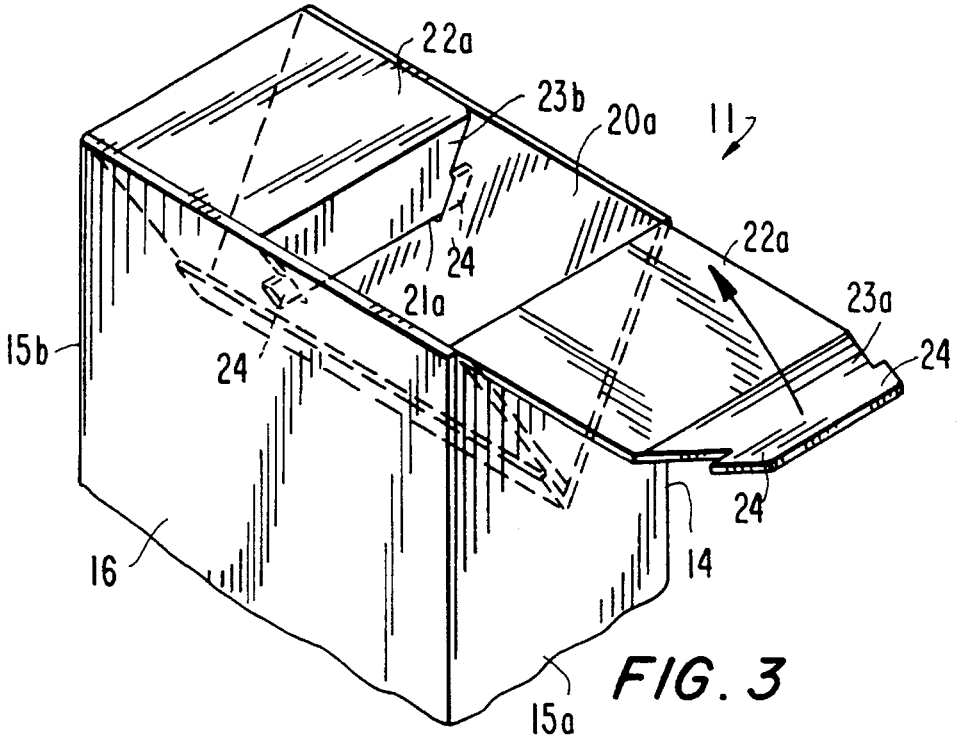
FIG. 3 is a perspective view akin to that of FIG. 2 but taken during the next following display stand formation phase.

Turning now to FIGS. 2 and 3 of the drawing, it may be observed there that the front wall 14 and, similarly, also the rear wall 16, is provided at its bottom region with a respective supporting flap 20*a* or 20*b*. The supporting flaps 20*a* and 20*b* are integral (of one piece) with their associated front or rear walls 14 and 16, being joined to them by respective crease lines. The flaps 20*a* and 20*b* extend, at respective acute angles, from such crease lines into the internal space of the display stand 11, and meet or are connected with one another by one or more connecting flaps. As shown, a connecting flap 20*c* extends from flap 20*a*, and is folded over flap 20*b* prior to being stapled or glued thereto. When thus connected, the flaps 20*a*, 20*b* and 20*c* together form a false bottom wall support structure that has a generally V-shaped cross section as considered in the upside down position of the stand 11 that is depicted in FIGS. 2 and 3. Of course, in the right side up orientation of the display stand 11 that is illustrated, for instance, in FIG. 4 of the drawing, this support structure presents an appearance reminiscent of an A-frame roof.

Alternately, the flap 20*c* extends from flap 20*a* parallel to the ground for a short distance prior to being connected to flap 20*b*. In another variation, each supporting flap 20*a* and 20*b* can have its own connecting flap 20*c* parallel to the ground and overlapping each other prior to being interconnected. In these latter two variations, the false bottom wall support structure has a flat-topped, V-shaped cross-section.

The supporting flaps 20*a* and 20*b* are provided, substantially centrally thereof as considered in a direction from one of the side walls 15*a* and 15*b* to the other, with respective slots 21*a* and 21*b*. The side walls 15*a* and 15*b*, similarly to the front and rear walls 14 and 16, are provided with respective integral true bottom wall portions 22*a* and 22*b* that, as indicated by respective arrows in FIGS. 2 and 3, are pivotable about respective hinge portions relative to the side walls 15*a* and 15*b*. The true bottom wall portions 22*a* and 22*b* are integrally provided, at their regions remote from the respective side walls 15*a* and 15*b*, with upholding flaps 23*a* and 23*b* that are provided at their lateral regions with respective locking tongues or tabs all of which are identified by the reference numeral 24.

As depicted, for instance, in FIG. 3 of the drawing, when the respective true bottom wall portion such as 22*a* assumes its final operative position in which it extends substantially normal to the peripheral walls 14, 15*a*, 15*b* and 16, the upholding flaps 23*a* and 23*b* extend substantially normal to the bottom wall portion 22*a* into the internal space of the display stand 11 that is already occupied and delimited by the flaps 20 and 20*b*, and its locking tabs 24 are received in the respective slots 21*a* and 21*b* of the supporting flaps 20 and 20*b* to ultimately lock the true bottom wall portion 22*a* and the supporting flaps 20*a* and 20*b* in their then assumed operative positions relative to one another.

Figure 5:
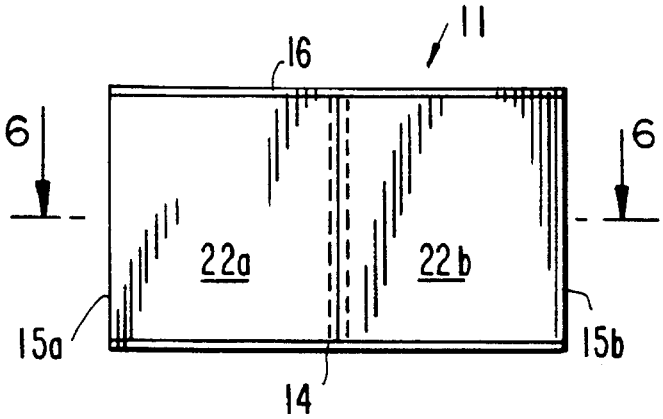
FIG. 5 is a bottom plan view of the display stand of FIG. 1 taken after the conclusion of the display stand formation operation depicted in FIGS. 2 to 4.

Similar, if not identical, conditions also prevail once the true bottom wall portion 22*b* and its associated upholding flap 23*a* are properly positioned relative to the peripheral walls 14 to 16 and the supporting flaps 20*a* and 20*b*, and the tabs 24 of the upholding flap 23*b* are introduced into the respective slots 21*a* and 21*b* as well. This results in a situation illustrated in FIG. 5 of the drawing where it may be seen that the true bottom wall portions 22*a* and 22*b* complement each other to form a quasi-unitary true bottom wall of the display stand 11 and thus of the container 10.

Figure 4:
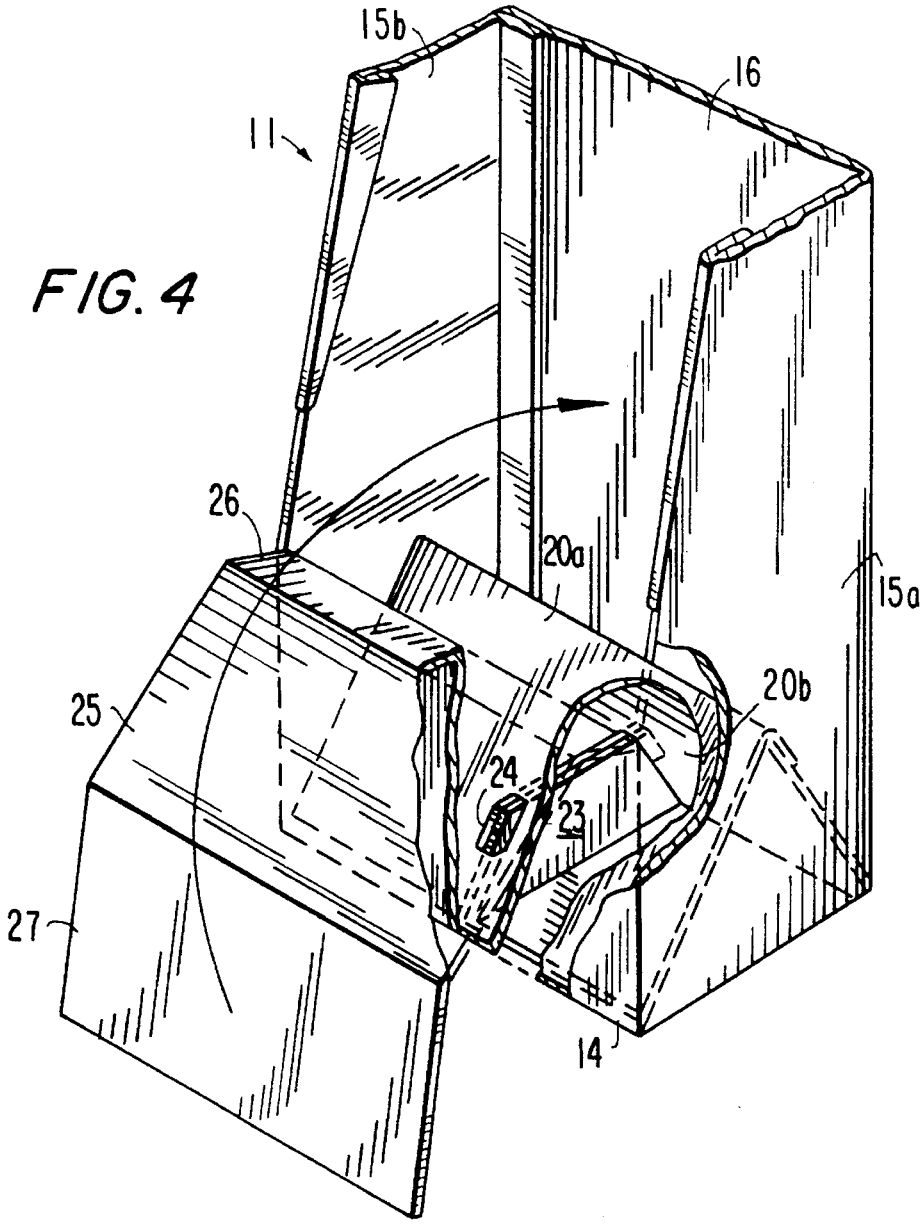
FIG. 4 is a perspective view of the display stand of FIGS. 1 to 3 taken during a still later phase of the display stand formation process but in a right side up orientation.

It may be observed in FIG. 4 of the drawing that the roof-shaped support structure constituted by the interconnected supporting flaps 20*a* and 20*b* also supports a false bottom 25 or shelf from below at a predetermined elevation above the true bottom 22*a*, 22*b* as considered in the orientation in which the display stand 11 is being used. The false bottom 25, which is to serve to support the articles 13 on display that are not yet present in the situation depicted in FIG. 4, is integral with the front wall 14 of the display container 11, being hingedly connected thereto by a strip-shaped connecting portion 26.

The false bottom 25 also carries, at its region remote from the connecting portion 26, a reinforcing panel 27. As illustrated in FIG. 8 of the drawing, in the condition in which the display stand 11 is to be used, the connecting portion or strip 26 extends parallel to the front wall 14 behind the same, thus holding the front portion of the false bottom 25 at a predetermined distance below the upper edge of the front wall 14 while the central portion of the false bottom wall rests, at substantially the same level, on the ridge presented by the interconnected supporting flaps 20*a* and 20*b*. In the above-described alternate variations, the central portion of the false bottom wall rests in area contact with one or more of the flaps 20*c* extending generally parallel to the ground. At the same time, the reinforcing panel 27 extends downwardly in parallelism with the rear wall 16 of the container 11, thus completing the false bottom supporting action at the rear portion of the false bottom 25. In this manner, the false bottom 25 is safely held at a predetermined distance corresponding to the height of the support structure 20*a*, 20*b* above the true bottom 22*a*, 22*b*.

It will be understood that each of the elements described above, or two or more together, may also find a useful application in other types of constructions differing from the type described above.

While the present invention has been described and illustrated herein as embodied in a specific construction of a shrouded shipping display container and stand, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A shrouded container, comprising:

a) a display stand including interconnected front, rear, side and bottom walls extending substantially normal to one another to give the display stand a general configuration of a rectangular prism and bounding an internal space for receiving items to be displayed when said display stand is in its erected position of use, said display stand further including a false bottom wall for the items on display to rest on, and means for supporting said false bottom wall at a predetermined elevation above said bottom wall, said supporting means including means for connecting a front region of said false bottom wall to said front wall of said display stand, and two supporting flaps integral with said front and rear walls of said display stand, respectively, and extending up from respective bottom regions thereof along upwardly sloping courses as considered in said erected position to reach said predetermined elevation, said supporting flaps being connected to each other and forming a support structure for said false bottom wall to rest on; and b) a shroud of a configuration substantially corresponding to said general configuration and including interconnected front, rear, and side walls corresponding to but having dimensions slightly exceeding those of said front, rear and side walls of said display stand, said shroud having an open bottom to enable said shroud to be slipped onto said display stand, and further including a top wall connected to said front, rear and side walls of said shroud and completing the enclosure of said internal space of said display stand from above when the shroud is mounted on the display stand to permit shipping of the items to be displayed in such enclosed space.

2. The shrouded container as defined in claim 1, wherein said connecting means includes a strip-shaped connecting portion integral with said false bottom wall and said front wall of said display stand and joined thereto by respective hinge portions, said connecting portion extending from an upper edge of said front wall downwardly into the internal space of said display stand as considered in said erected position in substantial parallelism with said front wall of said display stand to suspend said front region of said false bottom wall at a predetermined distance below said upper edge of said front wall of said display stand.

3. The shrouded container as defined in claim 1, and further comprising a reinforcing wall integral with and hingedly connected to said false bottom wall at a region thereof remote from said front region, said reinforcing wall extending in substantial parallelism and in contact with said rear wall of said display stand to enhance the supporting action of said supporting means.

4. The shrouded container as defined in claim 1, wherein said bottom wall of said display stand consists of two portions each integral with and hingedly connected to one of said side walls of said display stand.

5. The shrouded container as defined in claim 4, and further comprising a pair of upholding flaps each integral with and hingedly connected to a region of one of said two portions of said bottom wall that is remote from the respective side wall of said display stand and extending upwardly therefrom toward engagement with said supporting flaps.

6. The shrouded container as defined in claim 5, wherein said supporting flaps include respective slit-shaped openings; and wherein each of said upholding flaps includes a pair of oppositely disposed locking tabs each received in one of said openings of said supporting flaps to lock said upholding and supporting flaps in position relative to one another.

7. A display stand comprising:

a) interconnected front, rear and side walls extending substantially normal to one another to give the display stand a general configuration of a rectangular prism and bounding an internal space for receiving items to be displayed when said display stand is in its erected position of use;

b) a false bottom wall for the items on display to rest on; and c) means for supporting said false bottom wall at a predetermined elevation above ground in said use position, including i) means for connecting a front region of said false bottom wall to said front wall, and ii) two supporting flaps integral with said front and rear walls, respectively, and extending up from respective bottom regions thereof along upwardly sloping courses as considered in said erected position to reach said predetermined elevation, said supporting flaps being connected to each other, thus forming a support structure for said false bottom wall to rest on.

8. The display stand as defined in claim 7, wherein said connecting means includes a strip-shaped connecting portion integral with said false bottom wall and said front wall and joined thereto by respective hinge portions, said connecting portion extending from an upper edge of said front wall downwardly into the internal space as considered in said erected position in substantial parallelism with said front wall to suspend said front region of said false bottom wall at a predetermined distance below said upper edge of said front wall.

9. The display stand as defined in claim 7, and further comprising a reinforcing wall integral with and hingedly connected to said false bottom wall at a region thereof remote from said front region, said reinforcing wall extending in substantial parallelism and in contact with said rear wall to enhance the supporting action of said supporting means.

10. The display stand as defined in claim 7, and further containing a true bottom wall consisting of two portions, each integral with and hingedly connected to one of said side walls.

11. The display stand as defined in claim 10, and further comprising a pair of upholding flaps each integral with and hingedly connected to a region of one of said two portions of said bottom wall that is remote from the respective side wall and extending upwardly therefrom toward engagement with said supporting flaps.

12. The display stand as defined in claim 11, wherein said supporting flaps include respective slit-shaped openings; and wherein each of said upholding flaps includes a pair of oppositely disposed locking tabs each received in one of said openings of said supporting flaps to lock said upholding and supporting flaps in position relative to one another.

13. The display stand as defined in claim 7, wherein the supporting flaps reach said predetermined elevation substantially midway between said front and rear walls, thus forming the support structure reminiscent of an A-frame roof.

* * * * *